US010413947B2

(12) United States Patent
Borghi et al.

(10) Patent No.: US 10,413,947 B2
(45) Date of Patent: Sep. 17, 2019

(54) CONTAINMENT BASKET ADAPTED FOR BOTTLES OR SIMILAR CONTAINERS, IN PARTICULAR FOR WASHING OPERATIONS

(71) Applicant: IWT S.R.L., Casale Litta (VA) (IT)

(72) Inventors: Matteo Borghi, Legnano (IT); Michele Vitali, Angera (IT)

(73) Assignee: IWT S.R.L., Casale Litta (VA) (IT)

( * ) Notice: Subject to any disclaimer, the term of this patent is extended or adjusted under 35 U.S.C. 154(b) by 99 days.

(21) Appl. No.: 15/457,053

(22) Filed: Mar. 13, 2017

(65) Prior Publication Data

US 2017/0266703 A1 Sep. 21, 2017

(30) Foreign Application Priority Data

Mar. 15, 2016 (IT) ..... 102016000027053

(51) Int. Cl.
*B08B 9/08* (2006.01)
*A47L 15/50* (2006.01)
(Continued)

(52) U.S. Cl.
CPC ..... *B08B 9/0852* (2013.01); *A47L 15/501* (2013.01); *A47L 15/505* (2013.01); *B08B 9/0861* (2013.01); *B08B 9/093* (2013.01); *B65D 11/14* (2013.01); *B65D 21/0215* (2013.01); *B65D 25/108* (2013.01); *B65D 85/305* (2013.01); *B08B 9/423* (2013.01); *B65D 2501/24299* (2013.01)

(58) Field of Classification Search
CPC ..... A47L 15/505; A47L 15/504; A47L 15/50; A47L 15/501; B08B 9/0861; B08B 9/0852; B01D 21/0036; B01D 21/0215; B65D 85/305; D06F 59/00; D06F 5/005; D06F 95/006
USPC ..... 108/39
See application file for complete search history.

(56) References Cited

U.S. PATENT DOCUMENTS

2015/0305593 A1* 10/2015 Dabade ..... A47L 15/502 220/488

FOREIGN PATENT DOCUMENTS

DE 93 02 739 U1 4/1993
DE 2 2012 010187 1/2013
(Continued)

OTHER PUBLICATIONS

Italian Search Report dated Nov. 22, 2016, issued in Italian Application No. IT US20161683, filed Mar. 15, 2016.

*Primary Examiner* — Mollie Impink
(74) *Attorney, Agent, or Firm* — Workman Nydegger

(57) ABSTRACT

A containment basket adapted for bottles or similar containers includes: sidewalls, a base including grids or slots, an open side opposite to the base, and a fastening system on opposite first sidewalls of the basket; for securing fixed grids parallel to the base of the basket. The fixed grids include apertures for housing the bottles. Lateral guides on opposite second sidewalls of the basket are adapted for housing a lever system for positioning a sliding grid parallel to the fixed grids in a height-adjustable position. The sliding grid includes apertures suitable for housing the bottles. First windows on the second sidewalls are adapted to cooperate with the lever system to allow the height-adjustable positioning of the sliding grid and to allow the sliding grid to slide between a first bottle retaining position and a second bottle releasing position.

10 Claims, 10 Drawing Sheets

(51) Int. Cl.

| | |
|---|---|
| ***B08B 9/093*** | (2006.01) |
| ***B65D 6/08*** | (2006.01) |
| ***B65D 21/02*** | (2006.01) |
| ***B65D 25/10*** | (2006.01) |
| ***B65D 85/30*** | (2006.01) |
| *B08B 9/42* | (2006.01) |

(56) References Cited

FOREIGN PATENT DOCUMENTS

| | | | | | |
|---|---|---|---|---|---|
| FR | 1 587 567 | A | | 3/1970 | |
| FR | 1 588 044 | A | | 4/1970 | |
| GB | 191505232 | A | * | 9/1915 | ..... B65D 85/305 |
| IT | MI2011U000340 | | | 10/2011 | |

* cited by examiner

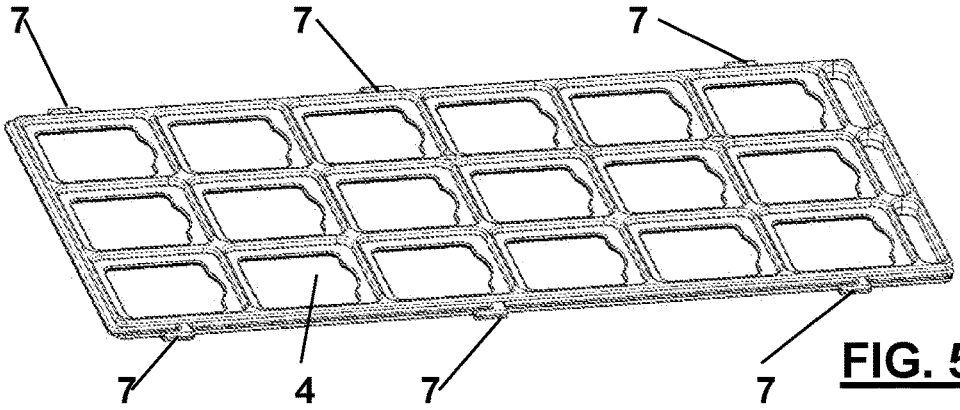
FIG. 5.1
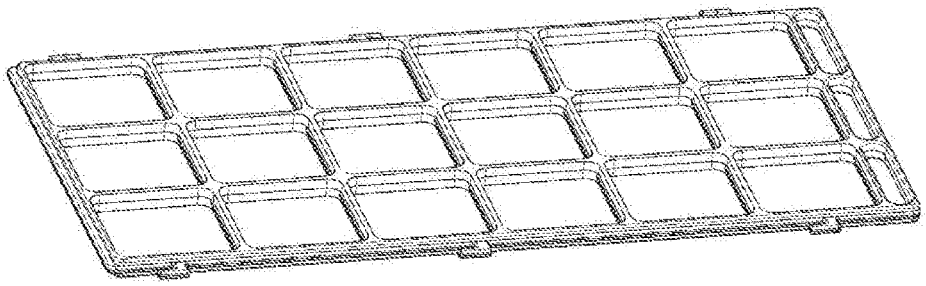
FIG. 5.2
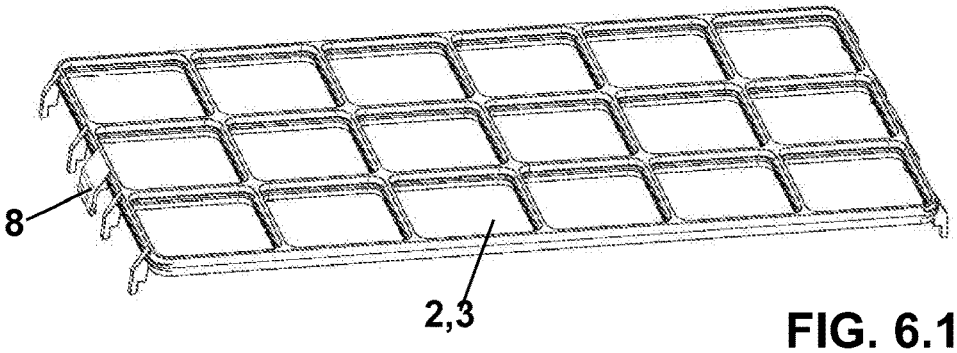
FIG. 6.1
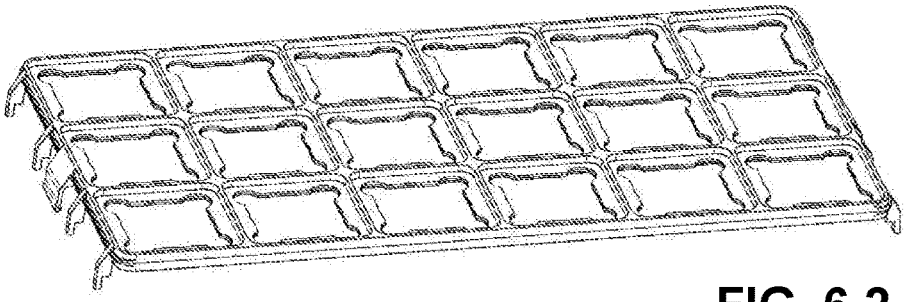
FIG. 6.2

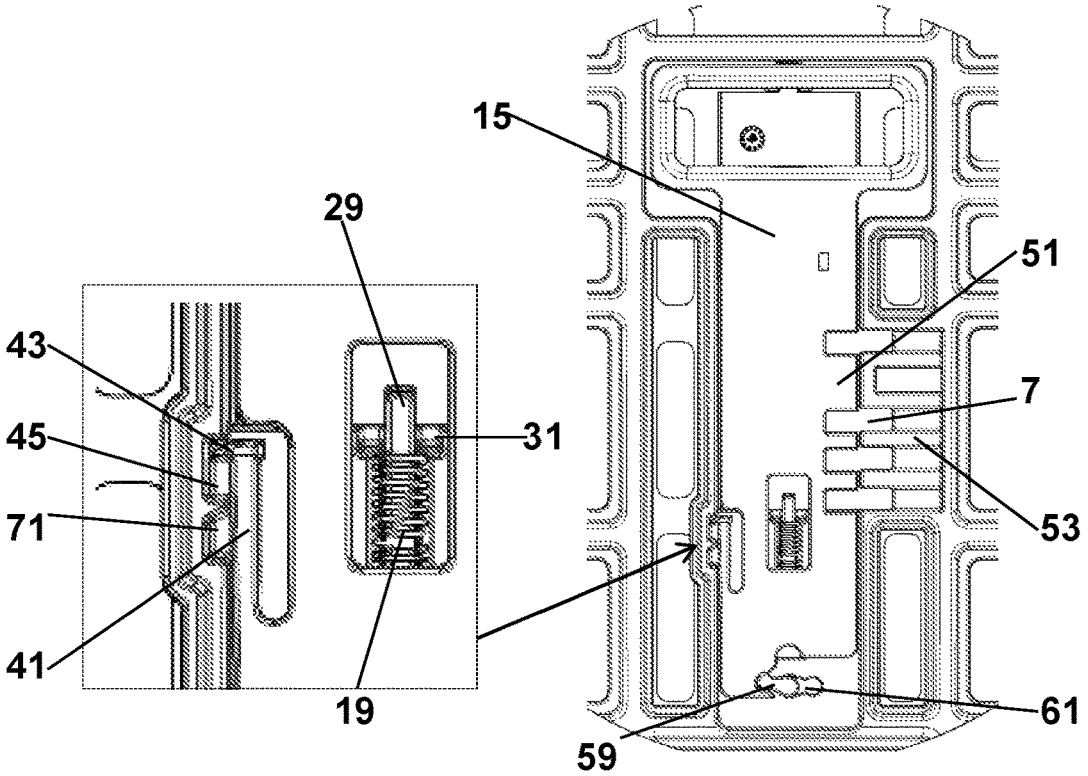
FIG. 8.1
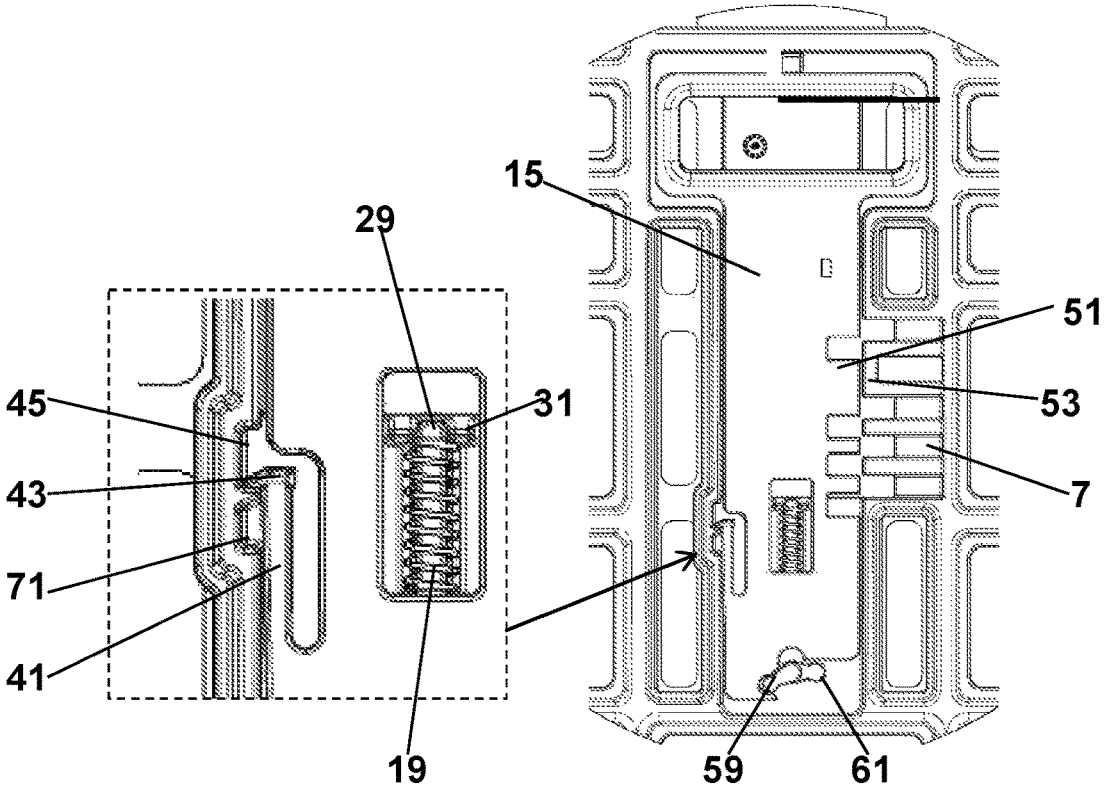
FIG. 8.2

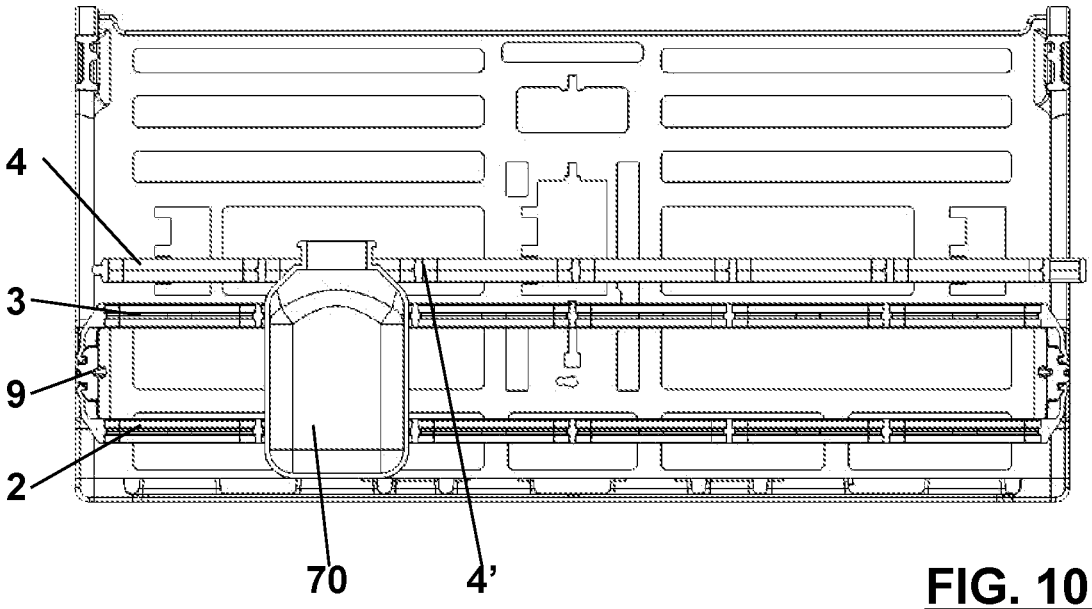
FIG. 10.1
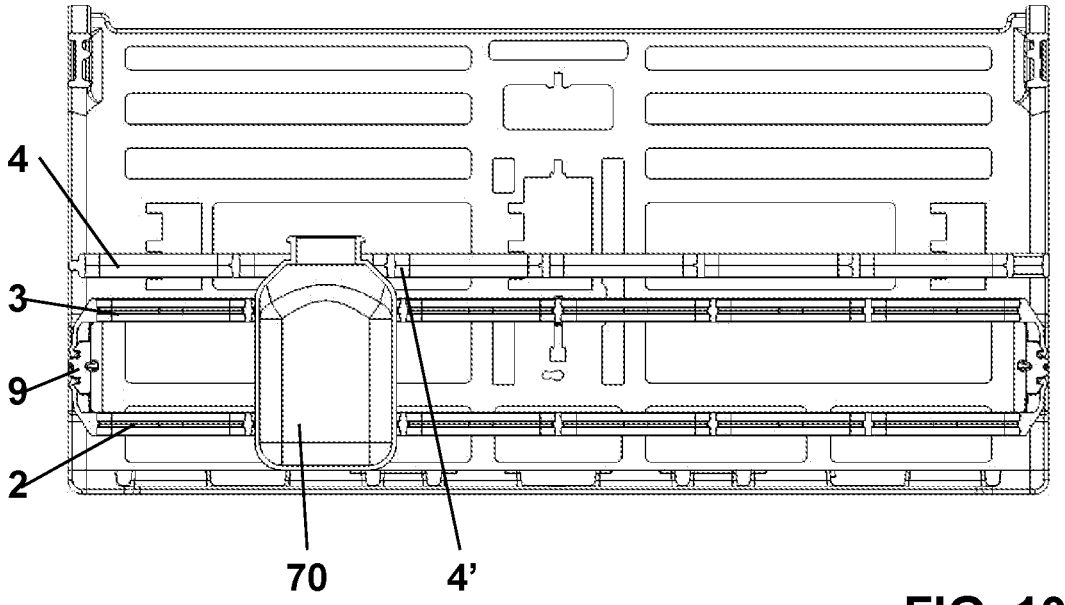
FIG. 10.2

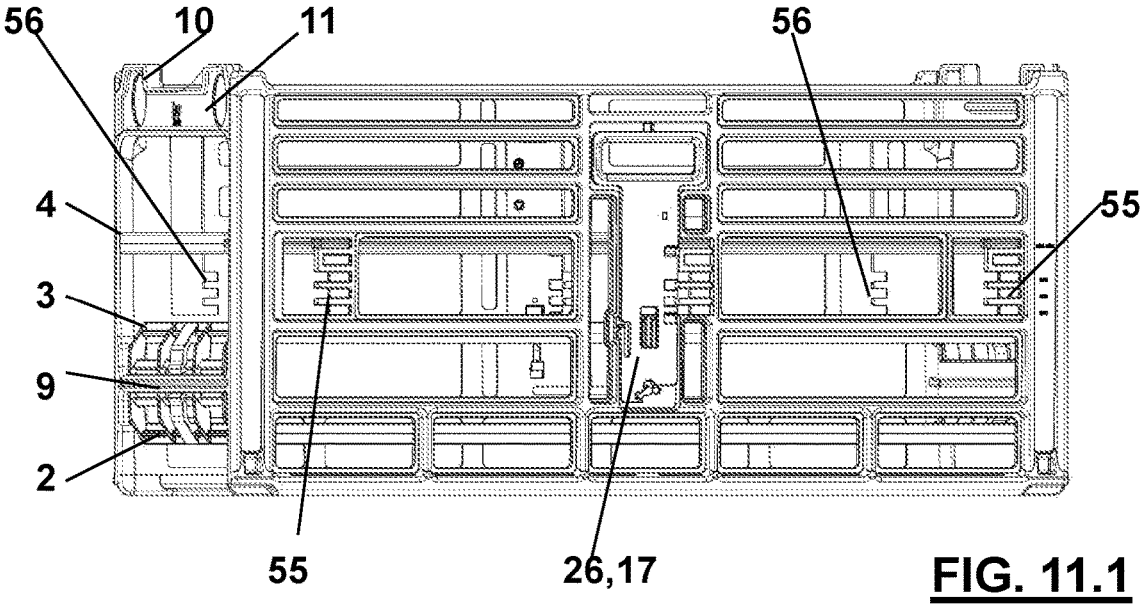
FIG. 11.1
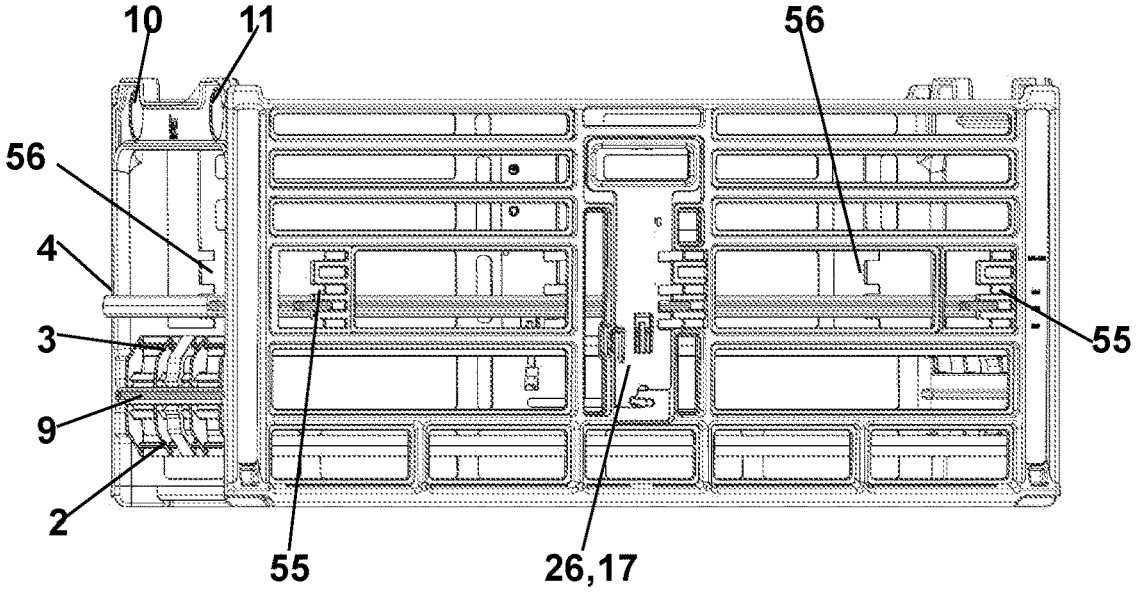
FIG. 11.2

CONTAINMENT BASKET ADAPTED FOR BOTTLES OR SIMILAR CONTAINERS, IN PARTICULAR FOR WASHING OPERATIONS

CROSS-REFERENCE TO RELATED APPLICATIONS

This application claims priority to Italian Application No. 102016000027053, filed Mar. 15, 2016, which is incorporated herein by specific reference.

DESCRIPTION

Field of the Invention

The present invention relates to a containment basket adapted for bottles or similar containers, e.g., for washing or cleaning operations.

Background Art

Containment baskets for bottles are known in the art, in particular for use in automatic operations for washing said bottles, the latter being in particular, without being limited to, the type commonly used for giving water to laboratory animals.

However, said known baskets suffer from problems that need to be solved.

Italian application for utility model MI2011U000340, filed by the present Applicant, describes a containment basket for bottles for use in automatic operations for washing said bottles, which is wholly made of stainless steel to withstand wash cycles using aggressive acidic and alkaline detergents as well as the high temperature set for autoclave cycles (131° C.) in order to sterilize the containers (bottles) for liquids placed in the basket.

The basket is provided with a bottle-retaining sliding grid to allow the execution of the wash process in fully automated systems, and also to allow easy manual removal of the bottles from the basket by the operator.

The sliding grid, made of laser-cut stainless steel sheet, slides on guides formed on the sidewalls of the basket and located at different levels to allow placing therein bottles of different shapes and dimensions. Also the grid has a different shape depending on the type of bottle contained in the basket.

The basket is equipped with four feet made of plastic material fitted into the four upper corners, which act as sliding pads when the basket is loaded upside-down into the washing machine.

The washing machine is, in fact, equipped with conveyor belts, and the plastic feet are useful to prevent friction, which may result in rapid belt wear.

However, said stainless steel basket equipped with a sliding grid still has a few drawbacks, which are listed below.

In the event of shocks or knocks caused by system malfunctions or incorrect use or handling by the operator, or by accidental falls, the stainless steel basket may, especially when loaded with bottles full of water, undergo permanent deformations that will impair the automatic process, causing unwanted downtime and loss of productivity.

It is known, in fact, that stainless steel does not have good elasticity properties, and high stresses exceeding the elastic capability of the material will produce permanent deformations.

The basket is conceived as a stainless steel wire structure. However, automated washing systems require very strict tolerances as concerns the basket dimensions, which make it necessary to use costly solutions such as welding robots or automatic wire and sheet-metal bending and cutting machines, resulting in high production costs and high prices of the finished product.

The sliding grid retains the bottles in the conical region of the neck thereof. Since the sliding grid is made from laser-cut sheet-metal, the sharp corner of the sheet that touches the neck may cause damage to bottles made of plastic material, the thickness of which is generally around 1 mm. Smoothing the sharp corners is a costly operation that does not guarantee a solution to the problem.

The basket is not always used for washing processes carried out by automated systems, where handling operations (loading and unloading from conveyor carriages, lifting, overturning, closing of the sliding grid) are executed by robots or handling devices. Very often the basket is used in animal breeding departments of research centers for bottle containment and transportation purposes only. In such a case, lifting and handling are carried out by operators, particularly by female personnel. It is clear that the weight of the stainless steel basket plays an important role in the ergonomics of such operations.

The stainless steel basket provides some flexibility in the handling of different types of bottles, since the type and position of the sliding grid can be changed, and the grid can be installed on guides suitably provided on the sides at various heights. However, if the basket needs to be used for different bottles, it is necessary to remove the sliding grid and change the position thereof, but this operation, though apparently simple for a skilled operator, still requires the use of special tools and may be difficult for a user who does not have an internal workshop available.

Therefore, a need arises for providing a containment basket suitable for containing bottles during washing operations, and having technical features that can overcome the above-described deficiencies.

SUMMARY OF THE INVENTION

It is therefore one object of the present invention to propose a containment basket adapted for bottles or similar containers, especially for washing operations, aimed at overcoming all of the above-mentioned drawbacks.

According to the present invention, the containment basket is made of plastic material and has a substantially parallelepiped structure with walls including grids or slots and an open top side.

The basket is suitable for containing one or more fixed intermediate grids and one sliding grid, said grids being adapted to contain and hold bottles or the like in a removable manner, and a lever system for retaining and releasing the sliding grid, thus retaining and releasing the bottles.

The present invention relates to a containment basket adapted for bottles or similar containers for liquids, characterized in that it is made of plastic material and has a substantially parallelepiped structure with sidewalls and a base including grids or slots and with an open side opposite to the base, and in that it comprises:

- a first fastening system on opposite first sidewalls of said basket, for securing one or more fixed grids made of plastic material parallel to the base of the basket, said fixed grids comprising apertures of a size suitable for housing said bottles;
- lateral guides made of plastic material on opposite second sidewalls of said basket, adapted for housing a lever system for positioning a sliding grid made of plastic material parallel to said one or more fixed grids and in an height-adjustable position along said second sidewalls, said sliding grid comprising apertures suitable for housing said bottles;

first windows on said second sidewalls, adapted to cooperate with said lever system in order to allow said height-adjustable positioning of said sliding grid, and also to allow said sliding grid to slide between a first bottle retaining position and a second bottle releasing position.

It is a particular object of the present invention to provide a containment basket adapted for bottles or similar containers, especially for washing operations, as specifically set out in the claims, which are an integral part of the present description.

BRIEF DESCRIPTION OF THE DRAWINGS

Further objects and advantages of the present invention will become apparent from the following detailed description of a preferred embodiment (and variants) thereof referring to the annexed drawings, which are only supplied by way of non-limiting example, wherein:

FIGS. 5.1, 5.2 show two variant embodiments of the sliding grid;

FIGS. 6.1, 6.2 show two variant embodiments of the fixed intermediate grid;

FIGS. 8.1, 8.2 show some details of the main lever of the lever system in positions raised from and lowered onto the basket sidewall, respectively;

FIGS. 10.1, 10.2 show a sectional front view of the basket that highlights the internal grids and a bottle, with the sliding grid in the bottle retaining and releasing positions, respectively;

FIGS. 11.1, 11.2 shows a perspective side view of the basket with the grids and the lever system, with the sliding grid in the high and low positions, respectively.

In the drawings, the same reference numerals and letters identify the same items or components.

DETAILED DESCRIPTION OF SOME EMBODIMENTS OF THE INVENTION

Figure 1:
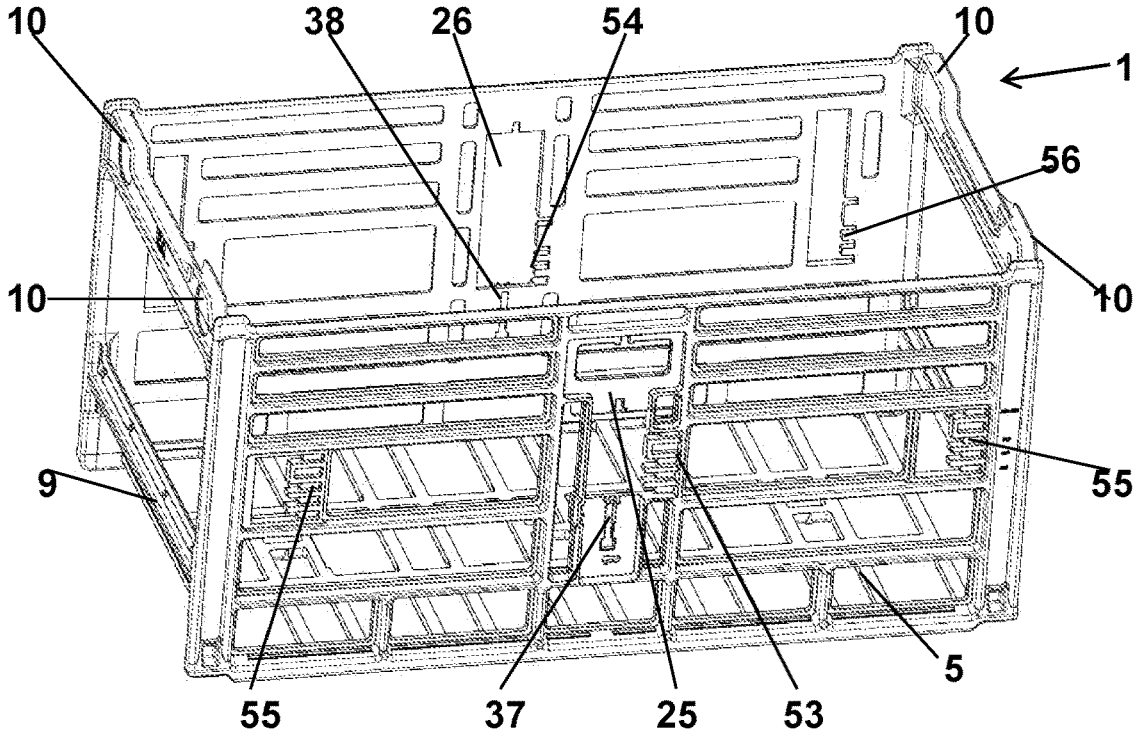
FIG. 1 shows an axonometric view of the containment basket according to the present invention.

With reference to the annexed drawings, the containment basket is made of plastic material and has a substantially parallelepiped structure with walls including grids or slots and with an open side.

The grids or slots, which may have variable shapes from point to point, contribute to making the structure lighter, in addition to allowing the wash liquids to flow through.

For easier understanding, the open side will hereafter be referred to as top side.

The basket further comprises one or more fixed intermediate grids and one sliding grid adapted to contain and hold bottles or the like, e.g., glass containers and beakers in use in research laboratories, in a removable manner, and a lever system for retaining and releasing the sliding grid, thus retaining and releasing the bottles.

The type of plastic material used for manufacturing the basket and its components is particularly suited to provide chemical-physical resistance to wash cycles with various types of detergents at the temperature normally set for autoclave sterilization cycles. In particular, a fiberglass-charged polymer has been found which is suitable for this purpose. More specifically, this is a thermoplastic resin suitable for hot-moulding processes, with a fiberglass percentage of approximately 40%. This type of raw material has been certified in accordance with the American FDA regulations for use in the food industry, which is an important requisite, e.g., in preclinical pharmaceutical research, for safeguarding the health of test animals.

In case of violent shocks or falls, the plastic basket offers the advantage that, though it may break, it will not become deformed, thus not giving rise to the well-known processability problems in automated washing systems.

The fully assembled plastic basket is very light, its weight being, in particular, approximately half the weight of a stainless steel basket, leading to evident benefits in terms of ergonomics for manual handling.

In the non-limiting example described herein, the basket 1 has a structure with a rectangular base, inside of which two fixed intermediate grids 2, 3 and one sliding grid 4 are inserted, all of which are arranged parallel to the basket base 5.

The intermediate grids 2, 3 and the sliding grid 4 (examples shown in FIGS. 5.1-6.2) have apertures of a size dependent on the size of the cross-section of the bottles that need to be loaded onto the basket, e.g., round, square, rectangular, and on the geometry of the bottle neck, which may become progressively narrower than the base.

The sliding grid 4 (FIGS. 5.1-5.2) is provided with lateral teeth 7 with an L-shaped extension developing at a distance from and parallel to the grid (three teeth for each one of the two longer sides), which are adapted to fit into the sidewalls of the basket, as will be described below.

The sliding grid 4, made of moulded plastic material, allows forming the corners that will come in contact with the bottle necks (the type of contact will be described below) with suitably rounded connections and without requiring higher costs, thus preventing any damage to the bottles, which may occur when using, for example, grids made of laser-cut sheet-metal.

Figure 9:
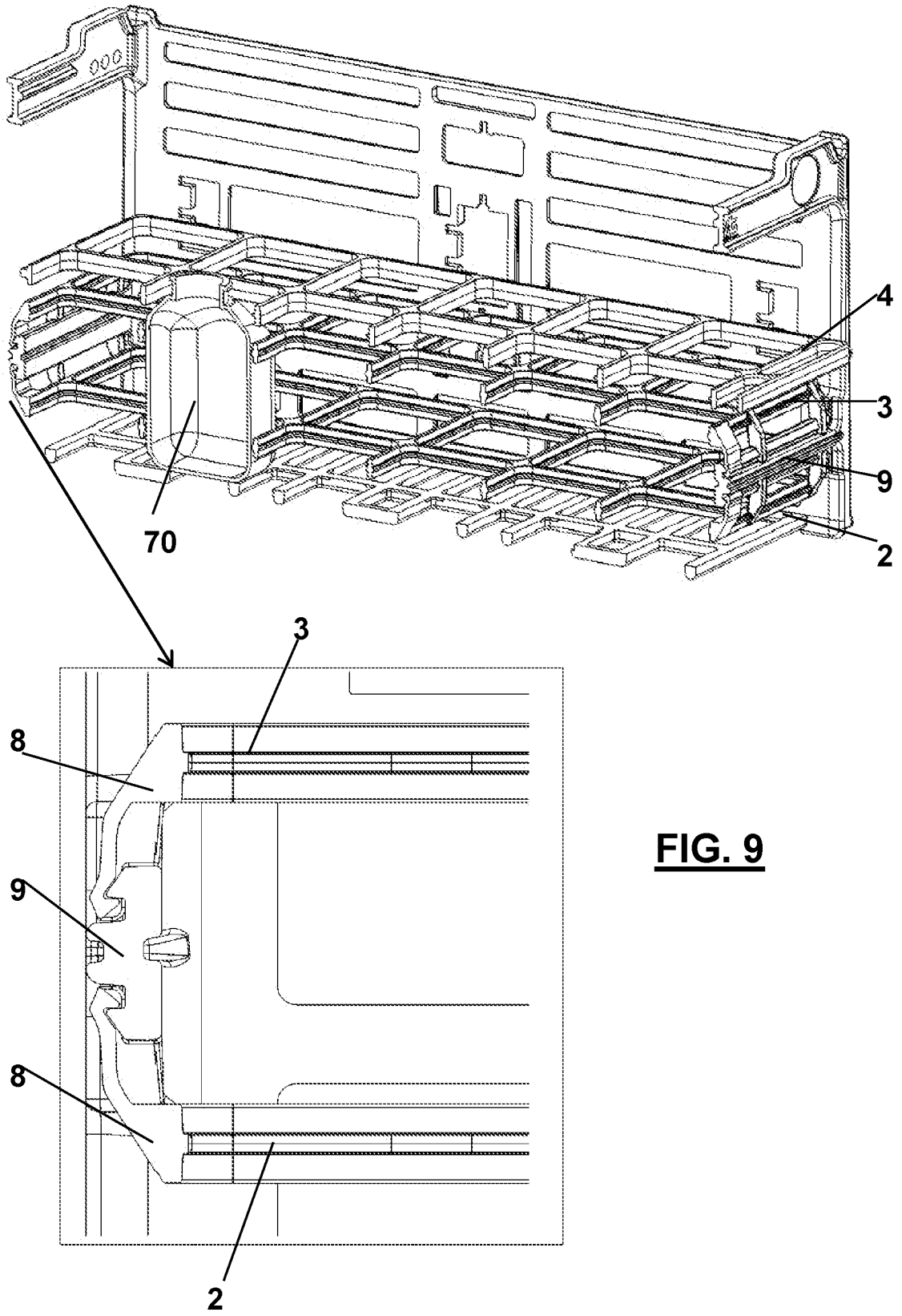
FIG. 9 shows a perspective vertical section of the basket, highlighting the internal grids and a bottle, with a magnified view of the fastening system of the fixed grids.
Figure 12:
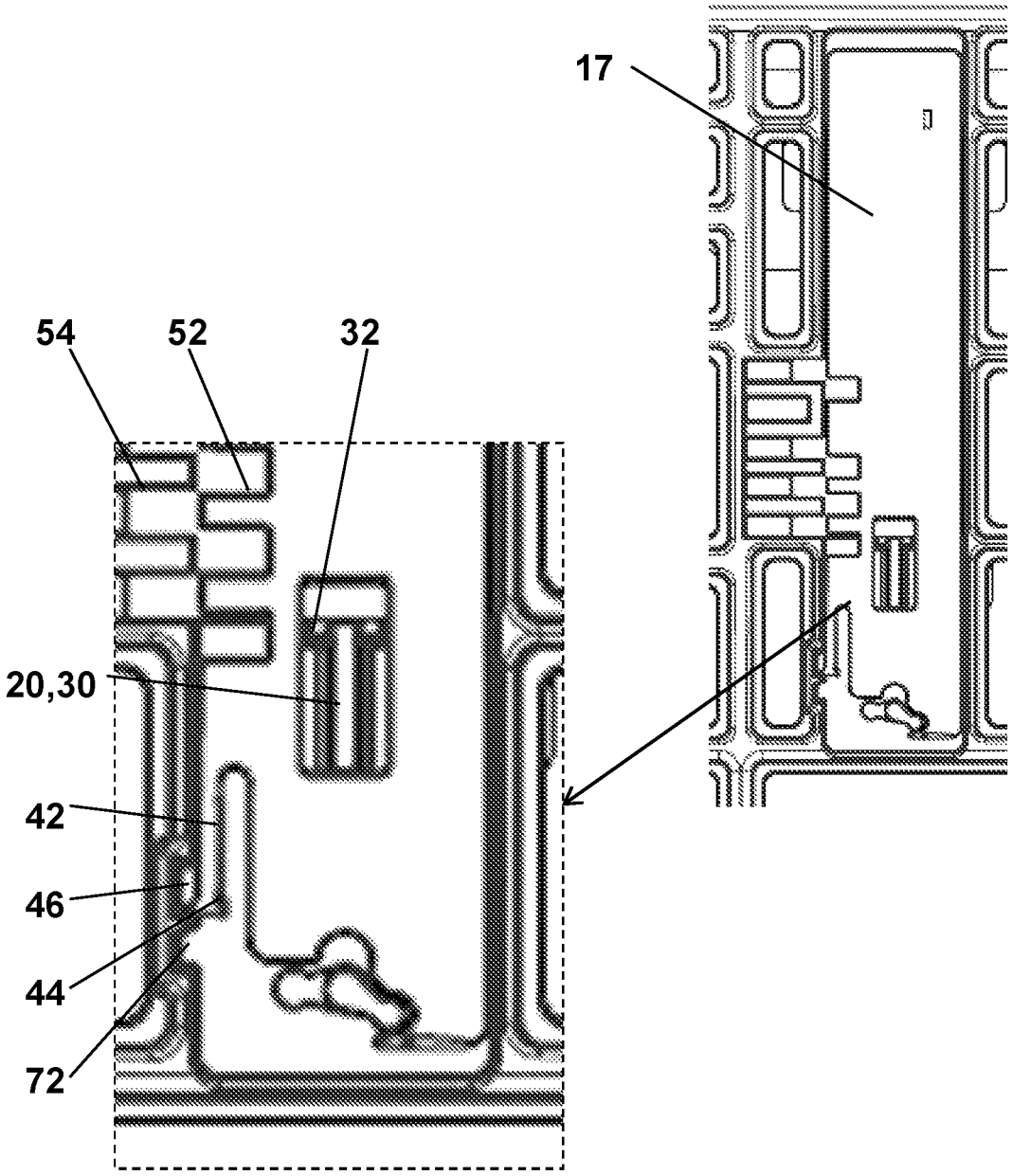
FIG. 12 shows some details of the counter-lever of the lever system.

The fixed grids 2, 3, (FIGS. 6.1, 6.2), also made of plastic material, are equipped with joint-type hooking systems 8 on both shorter sides of the basket, for connecting to the two respective shorter sidewalls, in particular to transverse bars 9 thereof, so that they can be easily assembled with the basket (see magnified detail in FIG. 9).

In particular, the hooking systems 8 protrude perpendicularly from the shorter sides of the fixed grids, so that the latter can be secured in mutually corresponding opposite positions on the bars 9, with one grid connected to the upper part and the other one connected to the lower part of the bars 9.

It is also possible to insert just one fixed grid instead of two, according to specific requirements.

The shorter sidewalls of the basket have, in their upper part, four projecting blocks 10 made of plastic material, directly obtained by moulding and forming handles 11 for manual gripping. The blocks 10 perform the function of supporting the basket when the latter is in the upside-down position, particularly when it is positioned on the bottle washing system, with the bottles loaded and retained in the basket.

Since they are made of plastic material, these blocks also avoid the need for applying four additional plastic feet, which would be necessary for a prior-art basket made out of stainless steel wire to avoid friction against the conveyor belts of the washing machines.

The following will describe the lever system for retaining and releasing the sliding grid.

The lever system (FIG. 7) is essentially made up of the following parts:

a main lever 15 with a handle 16;

a counter-lever 17;

a linking rod 18;

two stainless steel springs 19, 20 for lever return.

The lever, the counter-lever and the rod are made of the same plastic material as the containment box that constitutes the basket base.

Figure 3:
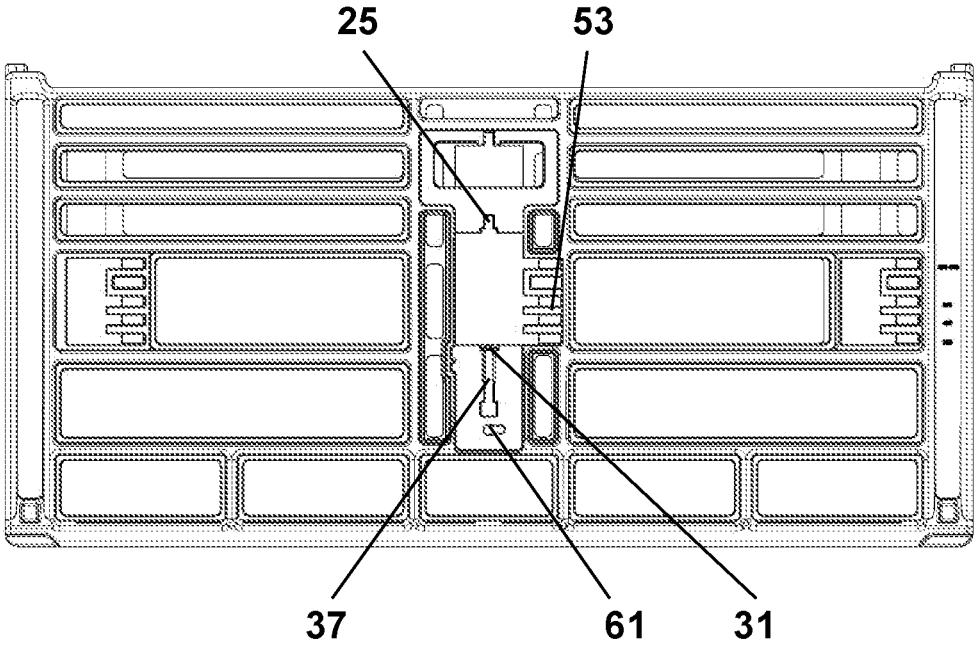
FIGS. 3 and 4 show views of the basket sidewalls adapted to house the lever system.
Figure 4:
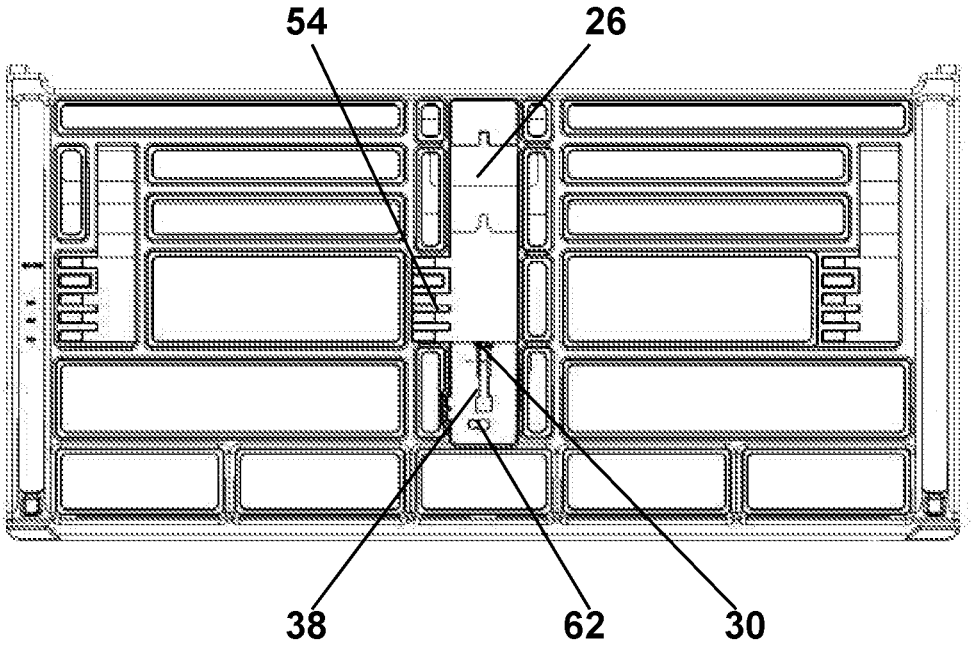

The main lever 15 with the handle 16 can slide vertically within a guide 25 formed on a sidewall of the basket (FIGS. 3, 8.1, 8.2, 11.1, 11.2).

Figure 2:
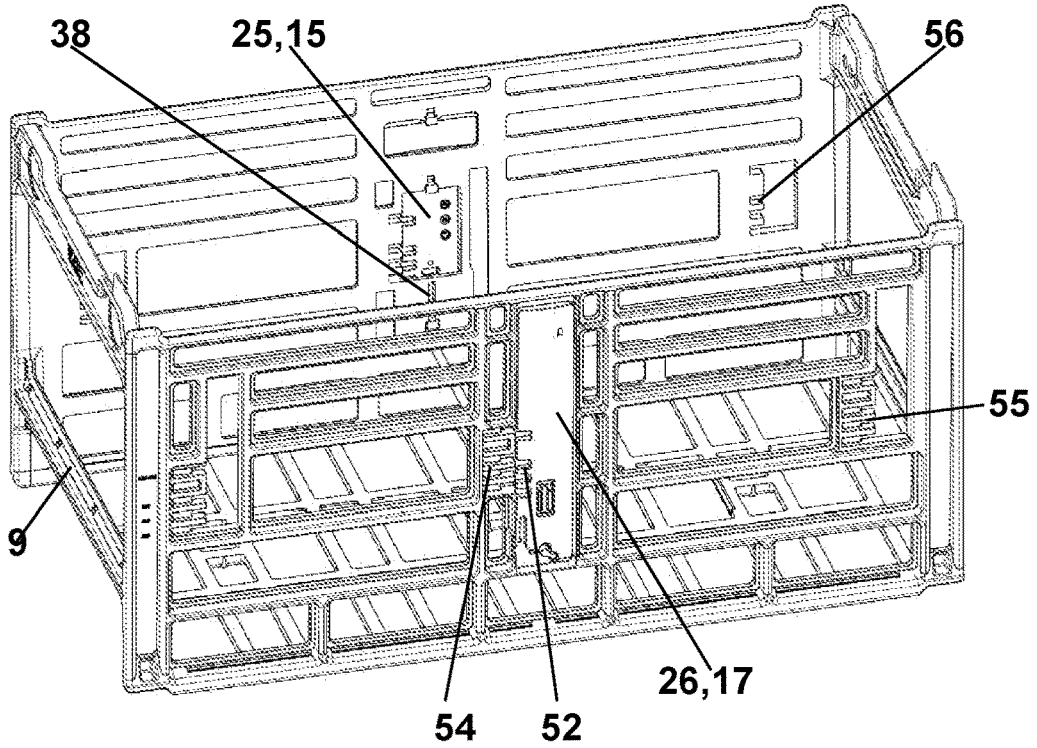
FIG. 2 shows an axonometric view of the containment basket including the lever system.

The counter-lever 17 can slide vertically (FIG. 2) within a corresponding guide 26 formed on the basket sidewall opposite to that whereon the main lever is positioned.

The linking rod 18 performs the task of synchronizing the vertical movements of the main lever and counter-lever.

Figure 7:
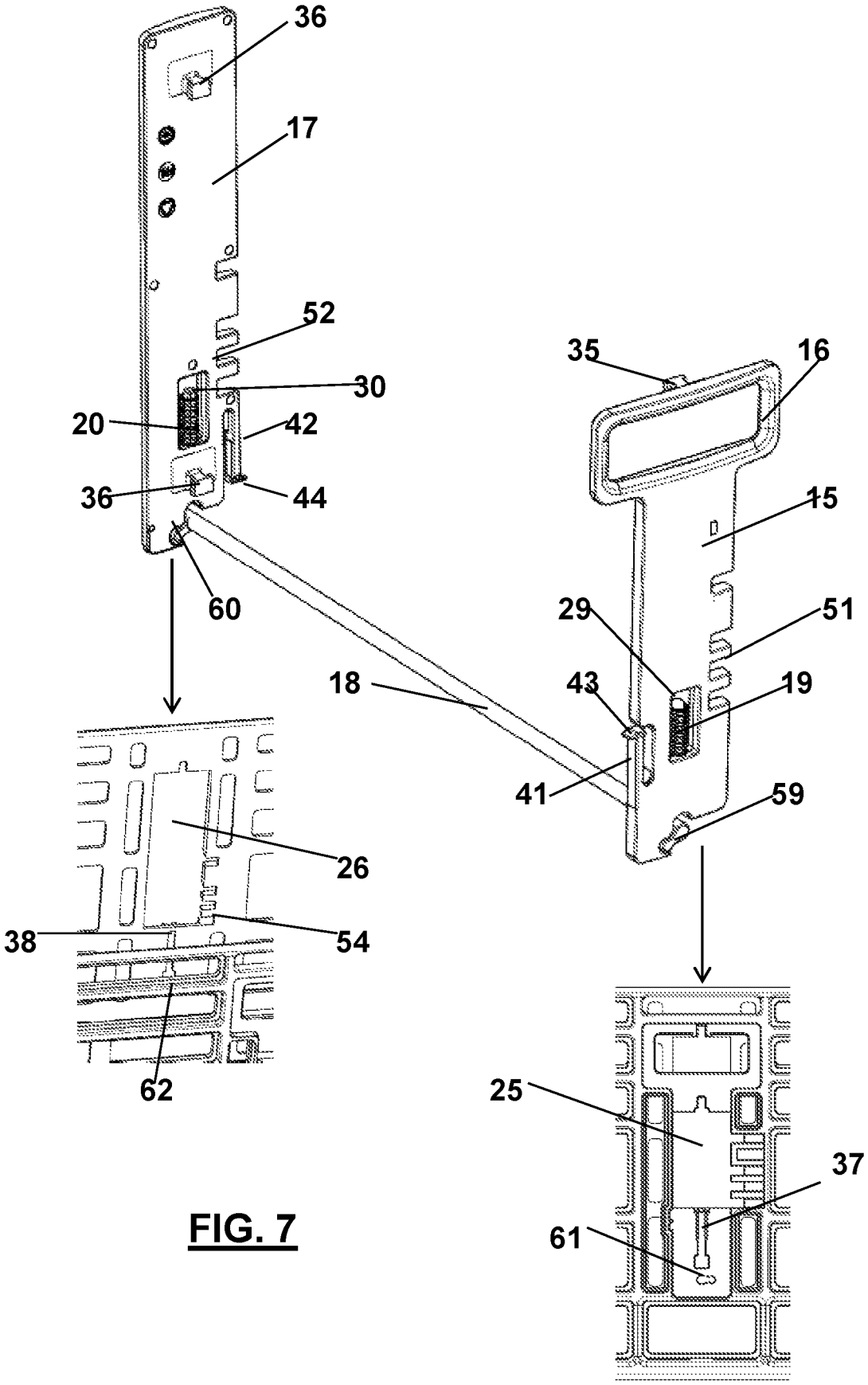
FIG. 7 shows an axonometric view of the lever system and magnified details of the basket sidewalls adapted to house the lever system.

Normally, the main lever 15 and the counter-lever 17 are pushed and held in the "low" idle position by a respective stainless steel spring 19, 20 inserted in a suitable respective support 29, 30 and countered by a respective abutment 31, 32 formed on the basic basket (see, in particular, FIGS. 7, 8.2).

"Dovetail" feet 35, 36 on the inner sides of each lever (FIG. 7) keep the levers engaged into cavities 37, 38 formed on the sidewalls of the basic basket (FIG. 1, 2).

Each lever is provided with a flexible element 41, 42 ending with a respective tooth 43, 44 to allow a small vertical translation of the lever within a respective cavity 45, 46 formed in the sidewalls of the guides 25, 26, thus preventing the two "dovetail" feet from coming out of the guides (FIGS. 8.1, 8.2).

In order to mount the levers on the basic basket, it is sufficient to bend, e.g., manually, the flexible element 41, 42 and slide the lever upwards until the tooth 43, 44 enters the region that limits the sliding in the respective cavity 45, 46.

The levers 15, 17 have respective side windows 51, 52 (FIG. 7). The flanks of the guides 25, 26 have respective windows 53, 54 facing the respective side windows 51, 52 of the levers.

In the (lowered) idle position of the levers, the windows 51, 52 are offset relative to the respective windows 53, 54 (FIGS. 8.2, 12); when the handle 16 is pulled up to cause the two levers to slide upwards, the windows 51, 52 come to face the respective windows 53, 54 (FIG. 8.1).

In said windows, the central lateral teeth 7 of the sliding grid 4 are inserted, so that they can slide horizontally when the windows are facing each other, or are retained inside the windows 53, 54 of the flanks of the guides when the windows are offset.

Additional windows 55, 56 are provided in the sidewalls of the basket, in such positions as to receive the additional lateral teeth 7 of the sliding grid, so as to allow the grid to slide horizontally while preventing it from moving in the vertical direction.

Multiple windows 51-56 are provided in the vertical direction, so that the sliding grid 4 can be positioned at different levels in the basket, depending on the height of the bottles that need to be treated (see, in particular, FIGS. 11.1, 11.2).

The sliding grid 4 can be released to allow it to slide horizontally by pulling the lever 15 upwards by means of the handle. The linking rod 18, which ends with two small "cams" 59, 60, one at each end, and which is hinged to the basket at respective lower points 61, 62 of the guides, will thus undergo a rotation, thereby transmitting the vertical sliding motion to the counter-lever 17.

The simultaneous vertical movement of both levers will allow aligning the teeth 7 on the sliding grid with the windows 51-54 on the levers themselves, thereby allowing the sliding grid to translate horizontally (FIG. 8.1).

In particular, FIGS. 10.1. 10.2 show the two positions of the sliding grid 4; FIG. 10.2 shows the retained position, in which the edge 4' of the aperture in the grid is in contact with the sidewall of the bottle 70 (only one is shown, but there may be one per aperture), thus holding and retaining it; FIG. 10.1 shows the released position, in which the edge 4' of the aperture in the grid is moved away from the sidewall of the bottle 70, thereby releasing it and allowing it to be removed. The released position also allows loading the bottles.

The bottles are positioned vertically with their opening at the top, so that, when the basket is turned upside-down, the bottles will have their open top facing down, ready for the washing operation, during which the liquid or fluid will be sprayed from below, penetrate the bottles, and exit by gravity.

The sliding grid 4 can be placed at a different level or replaced for processing other types of bottles or the like.

In order to remove the sliding grid 4 from the basket, it is first necessary to dismount the levers as follows:

Bring the sliding grid into the bottle retaining position.

Bend the flexible elements 41, 42 slightly in succession until the teeth 43, 44 come out of the respective cavities 45, 46 and enter the underlying cavities 71, 72.

Now the dovetail teeth 35, 36 of the levers will no longer be engaged into the respective cavities 37, 38, and the levers can be removed.

Once the levers have been removed, it will suffice to slide the sliding grid into the open position, so that the teeth 7 will come out of the guides 51-56 formed on the sidewalls of the basket.

By inclining the sliding grid with respect to the basket base, it can be moved vertically in order to change level as necessary or to completely remove it from the basket.

Once the sliding grid has been repositioned with the teeth inserted in the chosen guides 51-56, the levers can be mounted again by following the above-described procedure in the reverse order.

Figure 13:
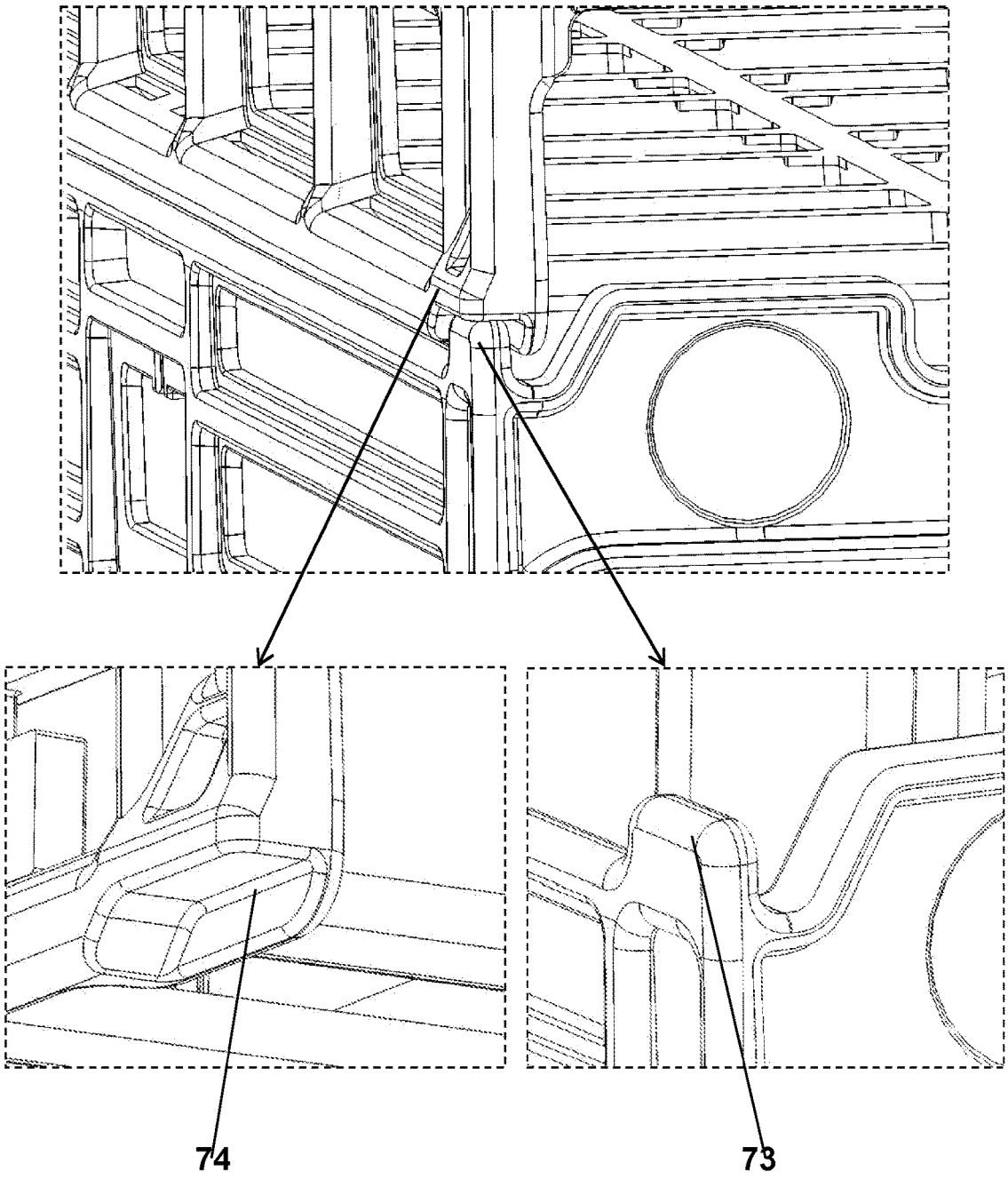
FIG. 13 shows some details of the basket, which allow piling up multiple baskets.

With particular reference to FIG. 13, it can be noticed that the conformation of the four upper corners 73 and lower corners 74 of the basket is advantageously complementary, so that the baskets can be piled up in a stable and easy manner. In particular, the upper corner 73 is shaped as an extension, while the lower corner 74 is shaped as a recess having such dimensions that it can firmly receive the matching corner 73 of the underlying basket.

It should be noted that the above-mentioned plastic material employed for manufacturing the baskets is also particularly suited to withstand the weight of stacked baskets containing bottles full of liquid, i.e., at full load. This may happen, for example, during autoclave sterilization steps, and represents the heaviest conditions that could cause deformation to plastic materials.

All the components of the lever system can be assembled without difficulty by any operator by following a simple procedure.

The basket gains much flexibility because it can be configured and adapted as necessary by executing simple assembly steps, whether for standard bottle types already available on the market or for new containers for liquids.

The above-described non-limiting example of embodiment may be subject to variations without departing from the protection scope of the present invention, including all equivalent designs known to a man skilled in the art.

The elements and features shown in the various preferred embodiments may be combined together without however departing from the protection scope of the present invention.

From the above description, those skilled in the art will be able to produce the object of the invention without introducing any further construction details.

The invention claimed is:

1. A containment basket adapted for bottles, wherein the containment basket is made of plastic material and has a substantially parallelepiped structure with first and second opposite sidewalls and a base including one or more fixed grids and one or more sliding grids and an open side opposite to the base, wherein the containment basket comprises:

a first transverse bar and a second transverse bar, respectively placed on opposite first sidewalls of the containment basket, the first transverse bar and the second transverse bar configured for securing the one or more of fixed grids parallel to the base of the containment basket, the one or more fixed grids comprising apertures of a size suitable for housing the bottles;

a first guide and a second guide formed on respective opposite second sidewalls of the containment basket, the first guide and the second guide being adapted for housing a lever system for positioning the one or more sliding grids parallel to the one or more fixed grids and in a height-adjustable position along the second sidewalls, the one or more sliding sliding grids comprising apertures suitable for housing the bottles;

first windows on the second sidewalls, adapted to cooperate with the lever system in order to allow the height-adjustable positioning of the one or more sliding grids, and also to allow the one or more sliding grids to slide between a bottle retaining position and a bottle releasing position.

2. The containment basket adapted for containing bottles as in claim 1, the lever system further comprising:

a main lever positioned in a height-slidable manner on the first guide;

a counter-lever positioned in a height-slidable manner on the second guide;

a linking rod adapted to connect the main lever to the counter-lever, so as to allow a synchronous sliding motion in a vertical direction;

the main lever and the counter-lever being equipped with second windows facing the first windows to allow the one or more sliding grids to be positioned into the bottle releasing position, and in height-offset positions relative to the first windows to allow the one or more sliding grids to be positioned into the bottle retaining position, the one or more sliding grids comprising lateral teeth adapted to slidably engage into the first and second windows.

3. The containment basket adapted for containing bottles as in claim 2, wherein the lever system includes return springs adapted to engage with the main lever, the counter-lever and the first and second guides, so as to realize an idle position of the main lever and the counter-lever, in which the bottle retaining position is achieved, and a contracted position, in which the bottle releasing position is achieved.

4. The containment basket adapted for containing bottles as in claim 2, wherein the main lever and the counter-lever comprise pins on inner sides of each of the main lever and the counter lever, which are adapted to slidably engage into cavities in the first and second guides, so as to allow the main lever and the counter-lever to slide in the vertical direction.

5. The containment basket adapted for containing bottles as in claim 3, wherein the main lever and the counter-lever comprises a respective flexible element ending with a respective tooth, the tooth being adapted to engage into a respective cavity in sidewalls of the first and second guides in order to limit the movement of the main lever and the counter-lever between the idle position and the contracted position, the movement being dependent on the width of the cavity.

6. The containment basket adapted for containing bottles as in claim 1, comprising the one or more fixed grids and the one or more sliding grids, in positions such that the respective apertures will align in the bottle releasing position, and such that the respective apertures will be offset in the bottle retaining position.

7. The containment basket adapted for containing bottles as in claim 1, comprising blocks on a top edge of the first and second opposing sidewalls, the blocks supporting a portion of the containment basket when the containment basket is turned upside-down.

8. The containment basket adapted for containing bottles as in claim 1, wherein the plastic material is a polymer charged with fiberglass, the polymer comprising thermoplastic resin suitable for hot-pressing processes, with a fiberglass percentage of approximately 40%.

9. The containment basket adapted for containing bottles as in claim 1, wherein upper corners and lower corners of the containment basket are so shaped as to have complementary protrusions and recesses matching together, to allow multiple containment baskets to be stably piled over each other.

10. The containment basket adapted for containing bottles as in claim 1, wherein the fixed grids comprise hooks at shorter sides, the hooks configured for securing the fixed grids to the first transverse bar and the second transverse bar.

* * * * *